US008905722B2

(12) United States Patent
Choi et al.

(10) Patent No.: US 8,905,722 B2
(45) Date of Patent: Dec. 9, 2014

(54) COMPRESSOR

(75) Inventors: Yoonsung Choi, Seoul (KR); Minchul Yong, Seoul (KR); Yunhi Lee, Seoul (KR); Joonhong Park, Seoul (KR)

(73) Assignee: LG Electronics Inc., Seoul (KR)

( * ) Notice: Subject to any disclaimer, the term of this patent is extended or adjusted under 35 U.S.C. 154(b) by 282 days.

(21) Appl. No.: 13/094,627

(22) Filed: Apr. 26, 2011

(65) Prior Publication Data

US 2012/0014816 A1 Jan. 19, 2012

(30) Foreign Application Priority Data

Jul. 14, 2010 (KR) ..... 10-2010-0068052

(51) Int. Cl.

| | |
|---|---|
| ***F04C 28/02*** | (2006.01) |
| ***F04C 14/02*** | (2006.01) |
| ***F04C 23/00*** | (2006.01) |
| ***F04C 29/12*** | (2006.01) |
| *F04C 18/356* | (2006.01) |

(52) U.S. Cl.

CPC ..... *F04C 23/001* (2013.01); *F04C 23/008* (2013.01); *F04C 2240/806* (2013.01); *F04C 18/356* (2013.01); *F04C 28/02* (2013.01); *F04C 29/12* (2013.01); *F04C 2240/50* (2013.01)

USPC ..... 417/62; 417/410.3; 418/60

(58) Field of Classification Search

CPC ..... F04C 11/008; F04C 11/00; F04C 11/001; F04C 15/06; F04C 23/00; F04C 23/001; F04C 23/008; F04C 2240/806; F04C 2250/10; F04C 2250/101; F04C 2250/102

USPC ..... 417/62, 244, 410.3, 902; 418/11, 60, 418/63–67

See application file for complete search history.

(56) References Cited

U.S. PATENT DOCUMENTS

| | | | | |
|---|---|---|---|---|
| 5,094,085 | A * | 3/1992 | Irino | 62/175 |
| 5,306,128 | A * | 4/1994 | Lee | 418/270 |
| 6,651,458 | B1 * | 11/2003 | Ebara et al. | 62/510 |
| 7,409,833 | B2 * | 8/2008 | Unger et al. | 62/196.2 |
| 7,520,733 | B2 * | 4/2009 | Matumoto et al. | 417/410.3 |
| 2006/0201171 | A1 | 9/2006 | Unger et al. | |
| 2008/0075609 | A1 * | 3/2008 | Tadano et al. | 417/410.3 |

FOREIGN PATENT DOCUMENTS

CN 1847662 A 10/2006

OTHER PUBLICATIONS

Chinese Office Action dated Oct. 28, 2013 for corresponding Application No. 201110133031.0.

* cited by examiner

*Primary Examiner* — Bryan Lettman
(74) *Attorney, Agent, or Firm* — KED & Associates, LLP

(57) ABSTRACT

A compression device includes a plurality of compressors in a shell. Each compressor includes a rolling piston that rotates within a cylinder to compress refrigerant. At least one valve allows refrigerant to be simultaneously or successively compressed by the compressors. A first pipe transfers refrigerant into one of the compressors, and a second pipe transfers refrigerant compressed in one of the compressors to another one of the compressors when the refrigerant is successively compressed by the compression mechanisms. The first and second pipes are coupled to the cylinder of one of the compressors.

17 Claims, 9 Drawing Sheets

COMPRESSOR

CROSS-REFERENCE TO RELATED APPLICATIONS

The present application claims priority under 35 U.S.C. 118B and 35 U.S.C. 365 to Korean Patent Application No. 10-2010-0068052, filed on Jul. 14, 2010, which is incorporated herein by reference.

BACKGROUND

1. Field

One or more embodiments disclosed herein relate to a compressor.

2. Background

A compressor is a mechanical apparatus that receives power from a power generation device such as an electric motor or a turbine to compress such fluid as air or refrigerant. Compressors are widely used for home appliances such as a refrigerator and an air-conditioner.

Compressors may be classified as one of a reciprocating compressor, a rotary compressor, or a scroll compressor. In a reciprocating compressor, a compression space in which refrigerant is introduced and discharged is defined between a piston and a cylinder, and the piston is linearly reciprocated within the cylinder to compress the refrigerant.

In a rotary compressor, a compression space in which refrigerant is introduced and discharged is defined between an eccentrically rotating roller and a cylinder, and the roller is eccentrically rotated along an inner wall of the cylinder to compress the refrigerant.

In a scroll compressor, a compression space in which refrigerant is introduced and discharged is defined between a rotatable scroll and a fixed scroll, and the rotatable scroll is rotated along the fixed scroll to compress the refrigerant.

The rotary compressor may be developed as a rotary twin compressor and a rotary two-stage compressor according to a refrigerant compression type. In the rotary twin compressor, two compression mechanisms are connected to each other in parallel, and a portion of the total compression capacity and a remaining compression capacity are respectively compressed in the two compression mechanisms. In the rotary two-stage compressor, two compression mechanisms are connected to each other in series, and refrigerant compressed by one of the two compression mechanisms is compressed again using the other compression mechanism.

In spite of their widespread use, compressors still have drawbacks.

DETAILED DESCRIPTION

Figure 1:
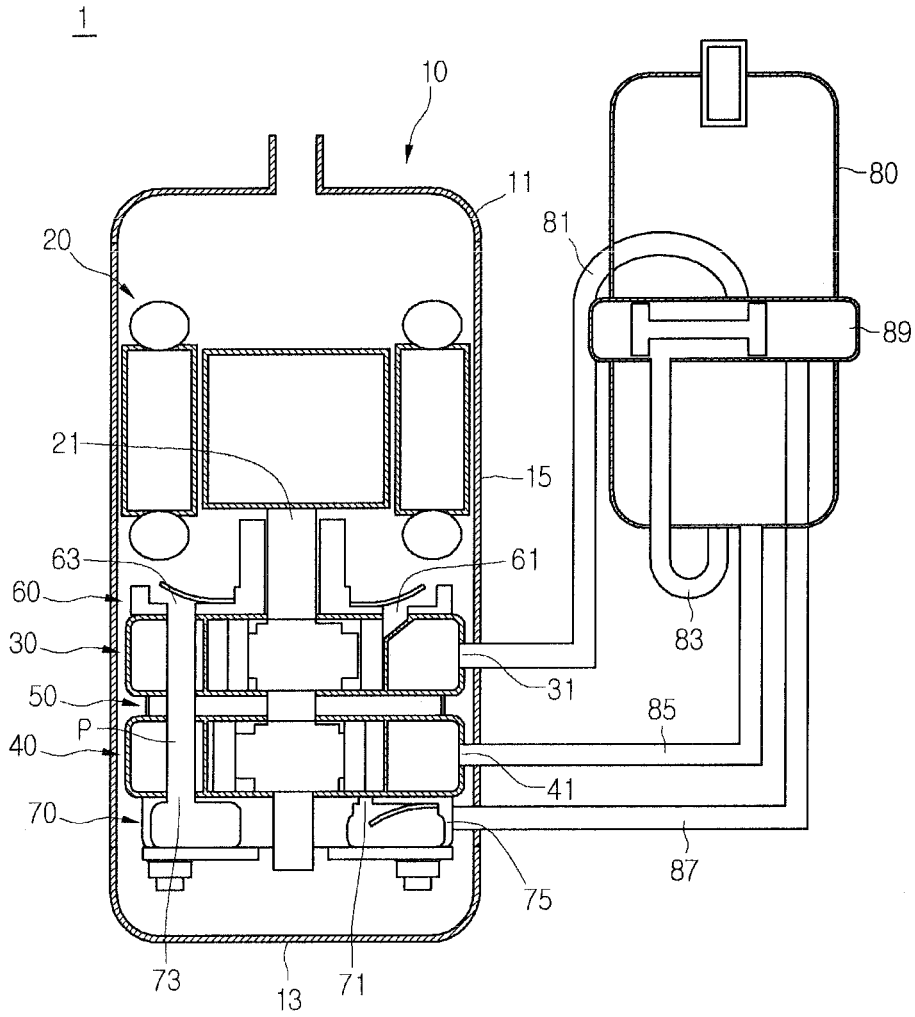
FIG. 1 shows one type of compressor.

FIG. 1 is a sectional view of one type of compressor 1 which includes a shell 10 defining an outer appearance thereof. The shell 10 includes a top cap 11, a bottom cap 13, and a casing 15. The top cap 11 and the bottom cap 13 define a portion of upper and lower outer appearances of the compressor 1, and the casing 15 defines the rest outer appearance of the compressor 1. A motor 20, an upper compression mechanism 30, a lower compression mechanism 40, an upper bearing 60, and a lower bearing 70 are disposed inside the shell 10.

The motor 20 is disposed in an upper portion of an inner space of the shell 10. The motor 20 includes a rotation shaft 21.

The upper compression mechanism 30 and lower compression mechanism 40 are vertically stacked in the shell 10 corresponding under the motor 20. The upper compression mechanism 30 and the lower compression mechanism 40 include an upper refrigerant suction hole 31 and a lower refrigerant suction hole 41, which suck the refrigerant, respectively. An intermediate bearing 50 is disposed between the upper compression mechanism 30 and the lower compression mechanism 40 to partition the upper compression mechanism 30 and the lower compression mechanism 40 from each other.

The upper bearing 60 and the lower bearing 70 are disposed above the upper compression mechanism 30 and above the lower compression mechanism 40, respectively. The upper bearing 60 includes first and second refrigerant discharge ports 61 and 63. The first refrigerant discharge port 61 is a port through which refrigerant compressed in the upper compression mechanism 30 or refrigerant compressed in the lower and upper compression mechanisms 40 and 30 in two stages is discharged into the inner space. The second refrigerant discharge port 63 is a port through which refrigerant compressed in the lower compression mechanism 40 is discharged into the inner space.

The lower bearing 70 includes a refrigerant suction port 71, a connection port 73, and an intermediate-pressure refrigerant discharge port 75. The refrigerant suction port 71 is a port through which refrigerant compressed in the lower compression mechanism 40 is sucked into the inner space of the lower bearing 70. The connection port 73 is a port through which refrigerant within the lower bearing 70, which is discharged into the inner space of the shell 10 is transferred into the second refrigerant discharge port 63. The intermediate-pressure refrigerant discharge port 75 is a port through refrigerant within the lower bearing 70 is transferred into the upper compression mechanism 30.

Also, a refrigerant discharge passage P through which refrigerant compressed by the lower compression mechanism 40 and discharged into the inner space of the shell 10 flows is provided. Substantially, the refrigerant discharge passage P passes through the upper compression mechanism 30, the lower compression mechanism 40, and the intermediate bearing 50. Also, the refrigerant discharge passage P has upper and lower ends, which respectively communicate with second refrigerant discharge port 63 and connection port 73.

The compressor 1 includes four pipes to allow the refrigerant to flow among the upper compression mechanism 30, the lower compression mechanism 40, and an accumulator 80. The pipes include first and second upper refrigerant supply pipes 81 and 83 which supply refrigerant into the upper compression mechanism 30, a lower refrigerant supply pipe 85 supplying refrigerant into the lower compression mechanism 40, an intermediate-pressure refrigerant discharge pipe 87 transferring refrigerant compressed in the lower compression mechanism 40 into the accumulator 80.

Both ends of the first upper refrigerant supply pipe 81 are connected to the upper refrigerant suction hole 31 and a four-way valve 89 (that will be described later), respectively. Both ends of the second upper refrigerant supply pipe 83 are connected to the accumulator 80 and the four-way valve 89, respectively. Also, both ends of the lower refrigerant supply pipe 85 are connected to the lower refrigerant suction hole 41 and the accumulator 80, respectively. Both ends of the intermediate-pressure refrigerant discharge pipe 87 are connected to the intermediate-pressure refrigerant discharge port 75 and the four-way valve 89, respectively.

The four-way valve 89 supplies refrigerant into the upper and lower compression mechanisms 30 and 40 according to the twin compression manner and the two-stage manner. For this, the four-way valve 89 selectively connects the first upper refrigerant supply pipe 81 to the second upper refrigerant supply pipe 83 or the intermediate-pressure refrigerant discharge pipe 87.

The upper refrigerant suction hole 41, the lower refrigerant suction hole 41, and the intermediate-pressure refrigerant discharge port 75, which are connected to the pipes are defined in the upper compression mechanism 30, the lower compression mechanism 40, and the lower bearing 70, respectively. Substantially, the upper compression mechanism 30, the lower compression mechanism 40, and the lower bearing 70 are vertically stacked with each other. Thus, the pipes may be vertically disposed in order of the first upper refrigerant supply pipe 81, the lower refrigerant supply pipe 85, and the intermediate-pressure refrigerant discharge pipe 87.

However, the compressor according to the related art has following limitations. First, as described above, the pipes are vertically disposed and fixedly welded to the shell 10. However, the pipes are substantially fixed to a lower portion of the casing 15 except the bottom cap 13. Also, the pipes are vertically spaced from each other in consideration of thermal deformation in a process in which the pipes are fixed. Thus, the whole height of the components disposed within the shell 10 is substantially increased to secure a predetermined height required for fixing the pipes.

As described above, when the upper compression mechanism 30 and the lower compression mechanism 40 are moved upward with the shell 10, the motor 20 is moved upward with respect to a bottom surface of the shell 10. That is, a distance between the motor 20 and the bottom surface of the shell 10 is increased. Also, when the motor 10 is disposed at a position relatively higher than that of the bottom surface of the shell 10, efficiency for discharging oil disposed under the shell 10 corresponding under the lower bearing 70 through an upper side of the motor 20 may be deteriorated.

Also, a center of overall gravity of the compressor is moved upward. Thus, vibration occurring due to the operations of the upper compression mechanism 30 and the lower compression mechanism 40 may be increased.

Figure 2:
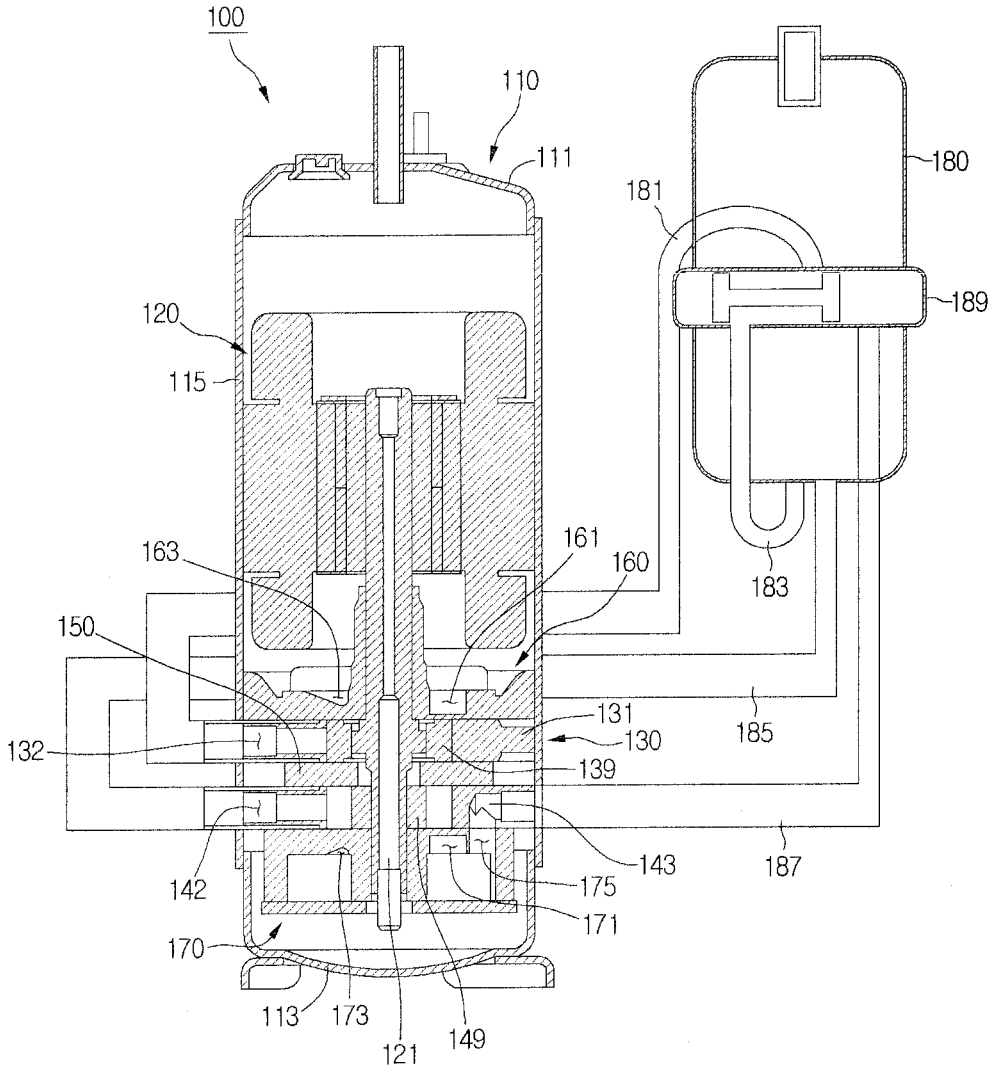
FIG. 2 shows one embodiment of another type of compressor.
Figure 3:
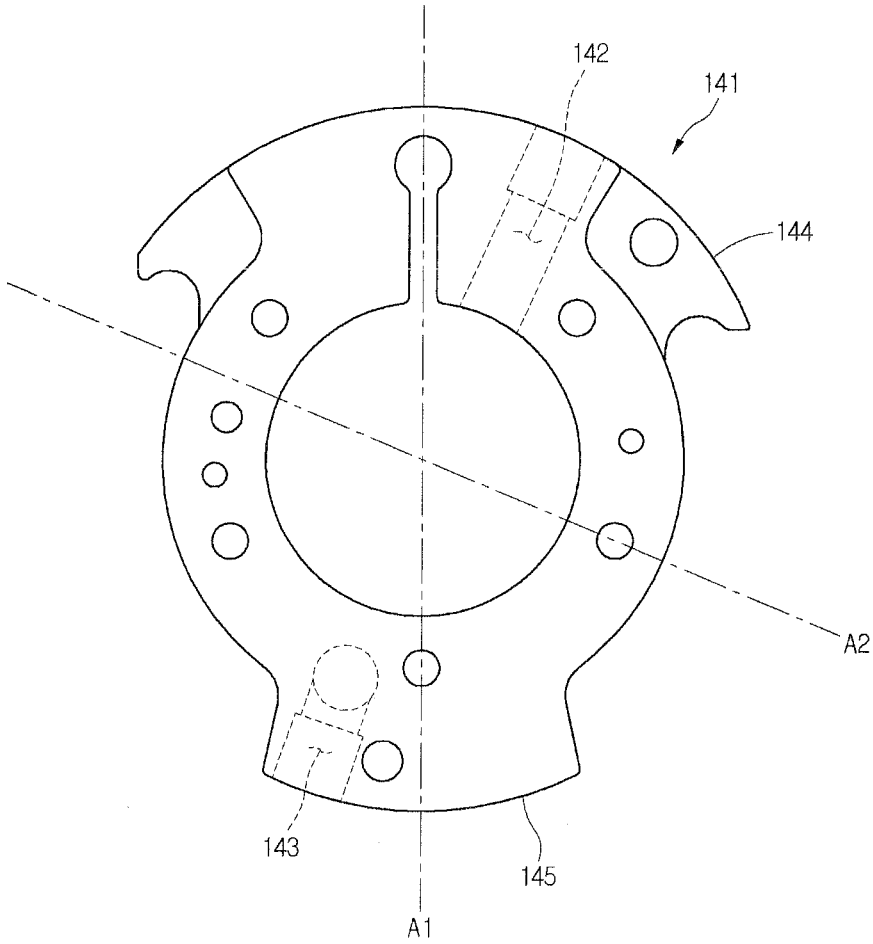
FIG. 3 shows a lower cylinder that may be used in the compressor of FIG. 2.

FIG. 2 is a sectional view of one embodiment of a compressor, and FIG. 3 is a plan view of a lower cylinder of this embodiment. Referring to FIG. 2, a compressor 100 according to the current embodiment includes a shell 110 defining an outer appearance thereof. The shell 110 includes a top cap 111, a bottom cap 113, and a casing 115. Substantially, the top cap 111 and the bottom cap 113 define a portion of upper and lower outer appearances of the compressor 100, and the casing 115 defines the rest outer appearance of the compressor 100. Various components such as a motor 120, an upper compression mechanism 130, a lower compression mechanism 140, an upper bearing 160, and a lower bearing 170 are disposed inside the shell 110.

In detail, the motor 120 provides a driving force to the upper compression mechanism 130 and the lower compression mechanism 140 to compress refrigerant. For this, the motor 120 is disposed at an upper portion of the shell 110, and a motor shaft 121 is disposed on the motor 120. Although not shown, a propeller for pumping oil is disposed on a lower end of the motor shaft 121. For example, a frequency variable motor that is speed-adjustable may be used as the motor 120.

The upper compression mechanism 130 and the lower compression mechanism 140 are driven by the motor 120 to compress the refrigerant. Here, the refrigerant flows into the upper and lower compression mechanisms 130 and 140 in series or parallel to perform twin compression or two-stage compression of the refrigerant.

Hereinafter, a case in which the refrigerant flows into the upper and lower compression mechanisms 130 and 140 in parallel to compress the refrigerant in each of the upper and lower compression mechanisms 130 and 140 is referred to as twin compression, and a case in which the refrigerant flows into the upper and lower compression mechanisms 130 and 140 in series to allow the refrigerant compressed in the lower compression mechanism 140 to be compressed again in the upper compression mechanism 130 is referred to as two-stage compression.

The upper compression mechanism 130 and the lower compression mechanism 140 are vertically stacked in the shell 110 corresponding under the motor 120. An intermediate bearing 150 is disposed between the upper compression mechanism 130 and the lower compression mechanism 140. Substantially, the intermediate bearing 150 vertically partitions the upper compression mechanism 130 and the lower compression mechanism 140 into upper and lower portions. The upper compression mechanism 130 and the lower compression mechanism 140 include an upper cylinder 131 and a lower rolling piston 139, and a lower cylinder 141 and a lower rolling piston 149, respectively.

The upper cylinder 131 provides a predetermined space for compressing the refrigerant using the upper rolling piston 139. Also, an upper refrigerant suction hole 132 for sucking the refrigerant is defined in the upper cylinder 131. Both ends of the upper refrigerant suction hole 132 are an inner circumference and an outer circumference of the upper cylinder 131, respectively. An inner end and an outer end of the upper refrigerant suction hole 132 communicate with an inner space of the upper cylinder 131 and a first upper refrigerant supply pipe 181 that will be described later, respectively.

The lower cylinder 141 provides a predetermined space for compressing the refrigerant using the lower rolling piston 149. A lower refrigerant suction hole 142 and an intermediate-pressure refrigerant discharge hole 143, which suck and discharge the refrigerant are defined in the lower cylinder 141. Both ends of the lower refrigerant suction hole 142 are disposed on an inner circumference and an outer circumference of the lower cylinder 141, respectively. An inner end and an outer end of the lower refrigerant suction hole 142 communicate with a lower refrigerant supply pipe 185 (that will be described later) and an inner space of the lower cylinder 141, respectively. Both ends of the intermediate-pressure refrigerant discharge hole 143 are disposed on the outer circumference and a bottom surface of the lower cylinder 141, respectively.

Thus, the intermediate-pressure refrigerant discharge hole 143 has an approximately "¬" shape. An outer end and a lower end of the intermediate-pressure refrigerant discharge hole 143 communicate with an intermediate-pressure refrigerant discharge pipe 185 and an intermediate-pressure refrigerant discharge port 173, which will be described later.

In the current embodiment, the upper cylinder 131 and the lower cylinder 141 are substantially disposed inside the casing 115, but the bottom cap 113. That is, the upper cylinder 131 and the lower cylinder 141 may horizontally overlap the casing 115.

Referring to FIG. 3, first and second projections 144 and 145 are disposed on the outer circumference of the lower cylinder 141. The first and second projects 144 and 145 radially extend from the outer circumference of the lower cylinder 141. The first and second projections 144 and 145 fix the lower cylinder 141 to the shell 110, i.e., the casing 115.

For example, each of the first and second projections 144 and 145 may have a fan shape having a relatively large diameter when compared to a diameter of the rest portion of the lower cylinder 141. Here, the first projection 144 may have a relatively large central angle than that of the second projection 145. The first and second projections 144 and 145 may be disposed on positions at which one line A1 (hereinafter, for convenience of description, referred to as a 'first line') of virtual lines passing through a center point of the lower cylinder 141 bisects each of the central angles. Thus, the first and second projections 144 and 145 may be substantially symmetrical with respect to the first line A1 bisecting each of the central angles of the first and second projections 144 and 145.

The outer end of the lower refrigerant suction hole 142 and the outer end of the intermediate-pressure refrigerant discharge hole 143 are disposed on outer circumferences of the first and second projections 144 and 145, respectively. In the current embodiment, the outer end of the lower refrigerant suction hole 142 is disposed on the outer circumference of the first lower refrigerant suction hole 142, and the outer end of the intermediate-pressure refrigerant discharge hole 143 is disposed on the outer circumference of the second projection 145. Also, the outer end of the lower refrigerant suction hole 142 and the outer end of the intermediate-pressure refrigerant discharge hole 143 may be disposed symmetrical to each other with respect to one line A2 (hereinafter, for convenience of description, referred to as a 'second line') of virtual lines crossing the first line A.

Referring again to FIG. 2, the upper rolling piston 139 and the lower rolling piston 149 are eccentrically and rotatably disposed inside the upper cylinder 131 and the lower cylinder 141, respectively. For this, the upper rolling piston 139 and the lower rolling piston 149 are connected to the motor shaft 121. Substantially, the refrigerant within the upper and lower cylinders 131 and 141 is compressed by the upper and lower rolling pistons 139 and 149 eccentrically rotated inside the upper and lower cylinders 131 and 141.

The upper and lower bearings 160 and 170 are disposed under the upper cylinder 131 or the lower cylinder 141. The upper bearing 160 is for discharging the refrigerant compressed in the upper and lower compression mechanisms 130 and 140. Also, the lower bearing 170 is for discharging the refrigerant compressed in the lower compression mechanism 140.

In detail, the upper bearing 160 is disposed inside the shell 110 corresponding under the upper compression mechanism 130. First and second refrigerant discharge ports 161 and 163 are defined in the upper bearing 160. The first refrigerant discharge port 161 is a port through which refrigerant compressed in the upper compression mechanism 130 in case of the twin compression manner or refrigerant compressed in the lower compression mechanism 140 and the upper compression mechanism 130 in case of the two-stage compression manner is discharged into the inner space of the shell 110. Also, the second refrigerant discharge port 163 is a port through which refrigerant compressed in the lower compression mechanism 140 in case of the twin compression manner is discharged into the inner space of the shell 110. The second refrigerant discharge port 163 communicates with a refrigerant discharge passage (not shown) that will be described later.

Also, although not shown, first and second refrigerant discharge valves are disposed on the first and second refrigerant discharge ports 161 and 163. The first and second refrigerant discharge valves may be controlled to discharge the refrigerant through the first and second refrigerant discharge ports 161 and 163 only when the refrigerant compressed in the upper compression mechanism 130 or/and the lower compression mechanism 140 is above a preset pressure. Also, the first and second refrigerant discharge valves may prevent the refrigerant from flowing backward.

The lower bearing 170 is disposed inside the shell 110 corresponding under the lower compression mechanism 140. Thus, the lower bearing 170 is substantially disposed inside the bottom cap 111, but the casing 115. That is, at least portion of the lower bearing 170 may horizontally overlap the bottom cap 111.

That is, in the current embodiment, as described above, the upper cylinder 131 and the lower cylinder 141 are disposed inside the casing 115, and the lower bearing 170 is disposed inside the bottom cap 113. This is done for a reason that the upper and lower cylinders 131 and 141 connected to the pipes are disposed inside the casing 115 and the lower bearing 170 to which the pipe is not connected is disposed inside the bottom cap 113 to downwardly move a center of overall gravity of the compressor 100 because the pipes for supplying the refrigerant pass through the casing 115, but the bottom cap 113.

A third refrigerant discharge port 171, a connection port 173, and an intermediate-pressure refrigerant discharge port 175 are defined in the lower bearing 170. The third refrigerant discharge port 171 is a port through which through which refrigerant compressed in the lower compression mechanism 140 in case of the twin compression manner or two-stage compression manner is discharged into the lower bearing 170. For this, both ends of the third refrigerant discharge port 171 communicate with the inner space of the lower cylinder 141 and the inner space of the lower bearing 170. In case of twin compression, the connection port 173 is a port through which refrigerant within the lower bearing 170 is transferred into the second refrigerant discharge port 163. For this, the connection port 173 communicates with a lower end of the refrigerant discharge passage and the inner space of the lower bearing 170.

Also, in case of two-stage compression, the intermediate-pressure refrigerant discharge port 175 is a port through which refrigerant within the lower bearing 170 is transferred into the upper compression mechanism 130. Thus, both ends of the intermediate-pressure refrigerant discharge port 175 communicate with a lower end of the intermediate-pressure refrigerant discharge hole 143 and the inner space of lower bearing 170.

A third refrigerant discharge valve (not shown) is disposed on the third refrigerant discharge port 171. The third refrigerant discharge valve may be controlled to discharge the refrigerant through the third refrigerant discharge port 171 only when the refrigerant compressed in the lower compression mechanism 140 is above a preset pressure. Also, the third refrigerant discharge valve may prevent the refrigerant from flowing backward.

Although not shown, a refrigerant discharge passage is defined in the compressor 100. In case of the twin compression manner, the refrigerant discharge passage discharges the refrigerant compressed in the lower compression mechanism 140 and supplied into the lower bearing 170. For this, the refrigerant discharge passage passes through the upper cylinder 131, the lower cylinder 141, and the intermediate bearing 150. Also, an upper end of the refrigerant discharge passage communicates with the first refrigerant discharge port 161, and a lower end of the refrigerant discharge passage communicates with the connection port 173. Substantially, the lower refrigerant discharge passage may be a component similar to the refrigerant discharge passage P of FIG. 1.

Gaseous refrigerant in which liquid refrigerant is removed in the accumulator 180 is supplied into the compressor 100. Also, four pipes for transferring the refrigerant are disposed between the accumulator 180 and the compressor 100. The pipes include first and second upper refrigerant supply pipes 181 and 183, a lower refrigerant supply pipe 185, and an intermediate-pressure refrigerant discharge pipe 187.

In detail, the first upper refrigerant supply pipe 181 supplies low-pressure refrigerant into the upper compression mechanism 130 in case of the twin compression manner. Also, the first upper refrigerant supply pipe 181 supplies intermediate-pressure refrigerant compressed by the lower compression mechanism 140 into the upper compression mechanism 130 in case of the two-stage compression manner.

The second upper refrigerant supply pipe 183 is opened by a four-way valve 189 (that will be described later) to communicate with the first upper refrigerant supply pipe 181 in case of the twin compression manner. However, the second upper refrigerant supply pipe 183 is closed by the four-way valves 189 in case of the two-stage compression manner.

The lower refrigerant supply pipe 185 supplies low-pressure refrigerant into the lower compression mechanism 140 regardless of a mode. That is, the lower refrigerant supply pipe 185 supplies the low-pressure refrigerant into the lower compression mechanism 140 in case of the twin compression manner and the two-stage compression manner.

Also, the intermediate-pressure refrigerant discharge pipe 187 is closed by the four-way valve 189 in case of the twin compression manner. Also, the intermediate-pressure refrigerant discharge pipe 187 communicates with the first upper refrigerant supply pipe 181 by the four-way valve 189 in case of the two-stage compression manner. Thus, in case of the two-stage compression manner, the refrigerant compressed in the lower compression mechanism 140 is supplied into the upper compression mechanism 130 by the intermediate-pressure refrigerant discharge pipe 187 and the first upper refrigerant supply pipe 181.

An end of the first upper refrigerant supply pipe 181, an end of the lower refrigerant supply pipe 185, and an end of the intermediate-pressure refrigerant discharge pipe 187 communicate with the upper refrigerant suction hole 132, the lower refrigerant suction hole 142, and the intermediate-pressure refrigerant discharge hole 143, respectively.

Also, the end of the first upper refrigerant supply pipe 181, the end of the lower refrigerant supply pipe 185, and the end of the intermediate-pressure refrigerant discharge pipe 187 are welded and fixed to an outer circumference of the casing 115, respectively. The upper refrigerant suction hole 132 is defined in the upper cylinder 131.

As described above, the lower refrigerant suction hole 142 and the intermediate-pressure refrigerant discharge hole 143 are defined in an outer circumference of the lower cylinder 141, i.e., an outer circumference of the first projection 144. Thus, in the case where the end of the first upper refrigerant supply pipe 181, the end of the lower refrigerant supply pipe 185, and the end of the intermediate-pressure refrigerant discharge pipe 187 are fixed to the outer circumference of the casing 115, a height difference among the first upper refrigerant supply pipe 181, the lower refrigerant supply pipe 185, and the intermediate-pressure refrigerant discharge pipe 187 may substantially correspond to that between the upper cylinder 131 and the lower cylinder 141.

Thus, when compared to FIG. 1, a height required for fixing the first upper refrigerant supply pipe 181, the lower refrigerant supply pipe 185, and the intermediate-pressure refrigerant discharge pipe 187 may be reduced.

The four-way valve 189 is disposed in the accumulator 180. The four-way valve 189 controls a flow of the refrigerant to allow the compressor 100, i.e., the upper compression mechanism 130 and the lower compression mechanism 140 to compress the refrigerant in the twin compressor manner or the two-stage compression manner. In detail, in case of the twin compression manner, the four-way valve 189 allows the first and second upper refrigerant supply pipes 181 and 183 to communicate with each other and allows the first upper refrigerant supply pipe 181 and the intermediate-pressure refrigerant discharge pipe 187 to be interrupted from each other.

Also, in case of the two-stage compression manner, the four-way valve 189 allows the first and second upper refrigerant supply pipes 181 and 183 to be interrupted from each other and allows the first upper refrigerant supply pipe 181 and the intermediate-pressure refrigerant discharge pipe 187 to communicate with each other. Thus, in case of the twin compression manner, in the four-way valve 189, the low-pressure refrigerant is supplied into the upper compression mechanism 130 through the first and second upper refrigerant supply pipes 181 and 183.

Also, in case of the two-stage compression manner, in the four-way valve 189, the low-pressure refrigerant is supplied into the lower compression mechanism 140 through the lower refrigerant supply pipe 185, and the intermediate-pressure refrigerant compressed by the lower compression mechanism 140 is supplied into the upper compression mechanism 130 through the intermediate-pressure refrigerant discharge pipe 187 and the first supper refrigerant supply pipe 181.

Figure 6:
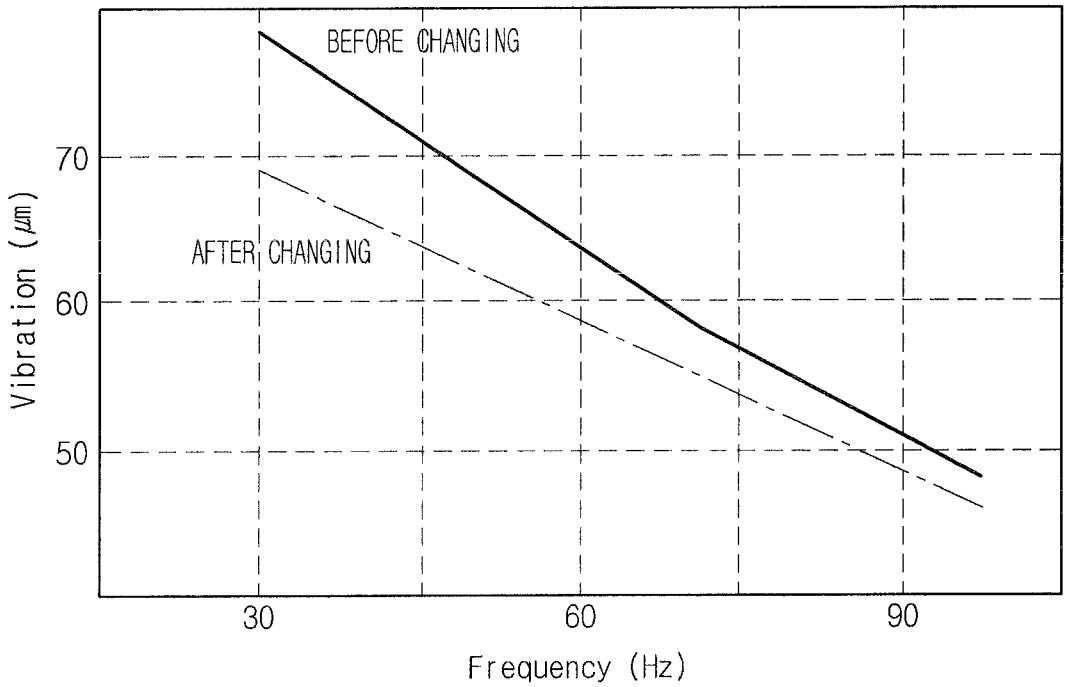
FIG. 6 is a graph showing a difference between feed amounts of oil of the compressors of FIGS. 1 and 2.
Figure 7:
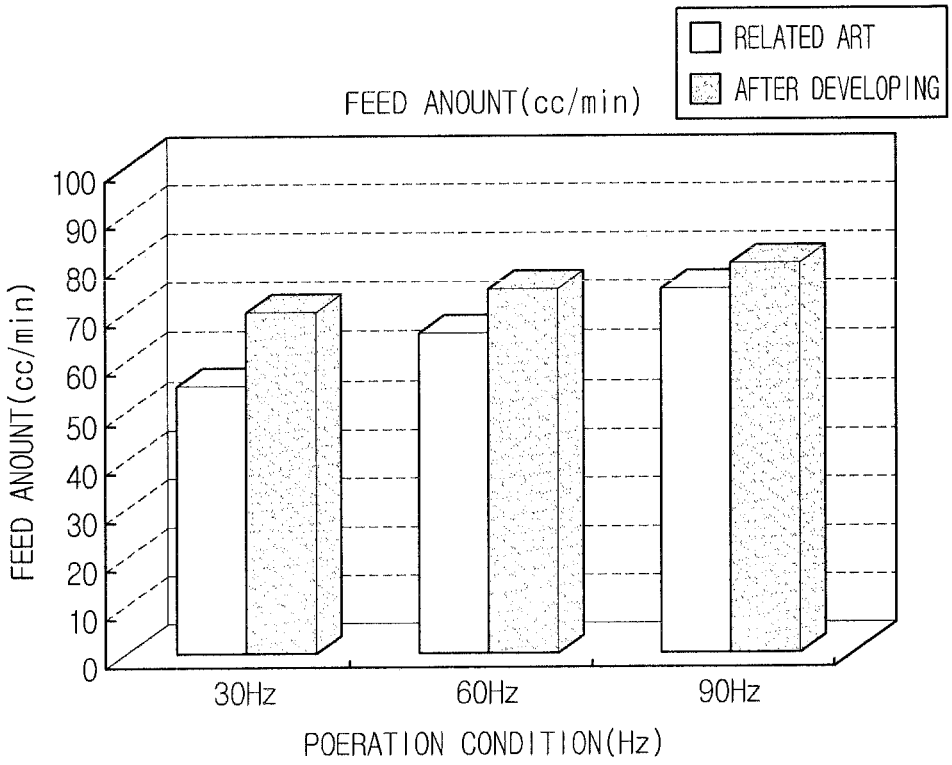
FIG. 7 is a graph showing a difference between capacities of the compressors of FIGS. 1 and 2.
Figure 8:
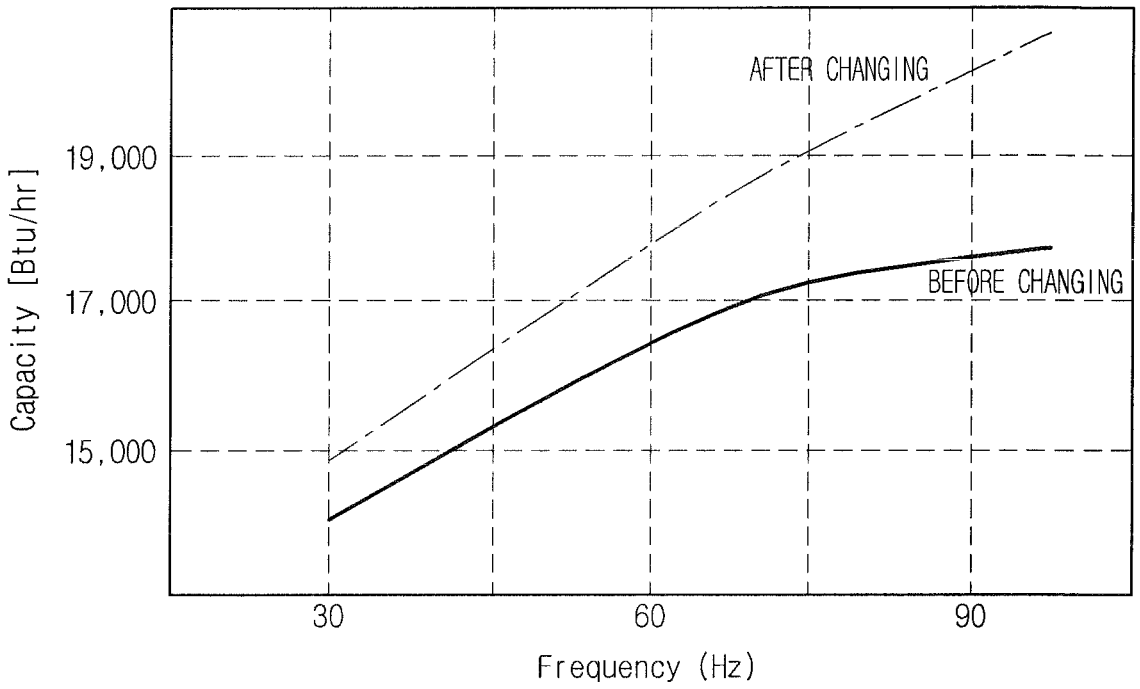
FIG. 8 is a graph showing a difference between vibration frequencies of the compressors of FIGS. 1 and 2.

Hereinafter, an operation of the compressor of FIGS. 2 and 3 will be described with reference to FIGS. 4 and 5. Also, FIG. 6 is a graph illustrating a difference between the feed amounts of oils of the compressors of FIGS. 1 and 2, FIG. 7 is a graph illustrating a difference between capacities of the compressors of FIGS. 1 and 2, and FIG. 8 is a graph illustrating a difference between vibration frequencies of the compressors of FIGS. 1 and 2.

Figure 4:
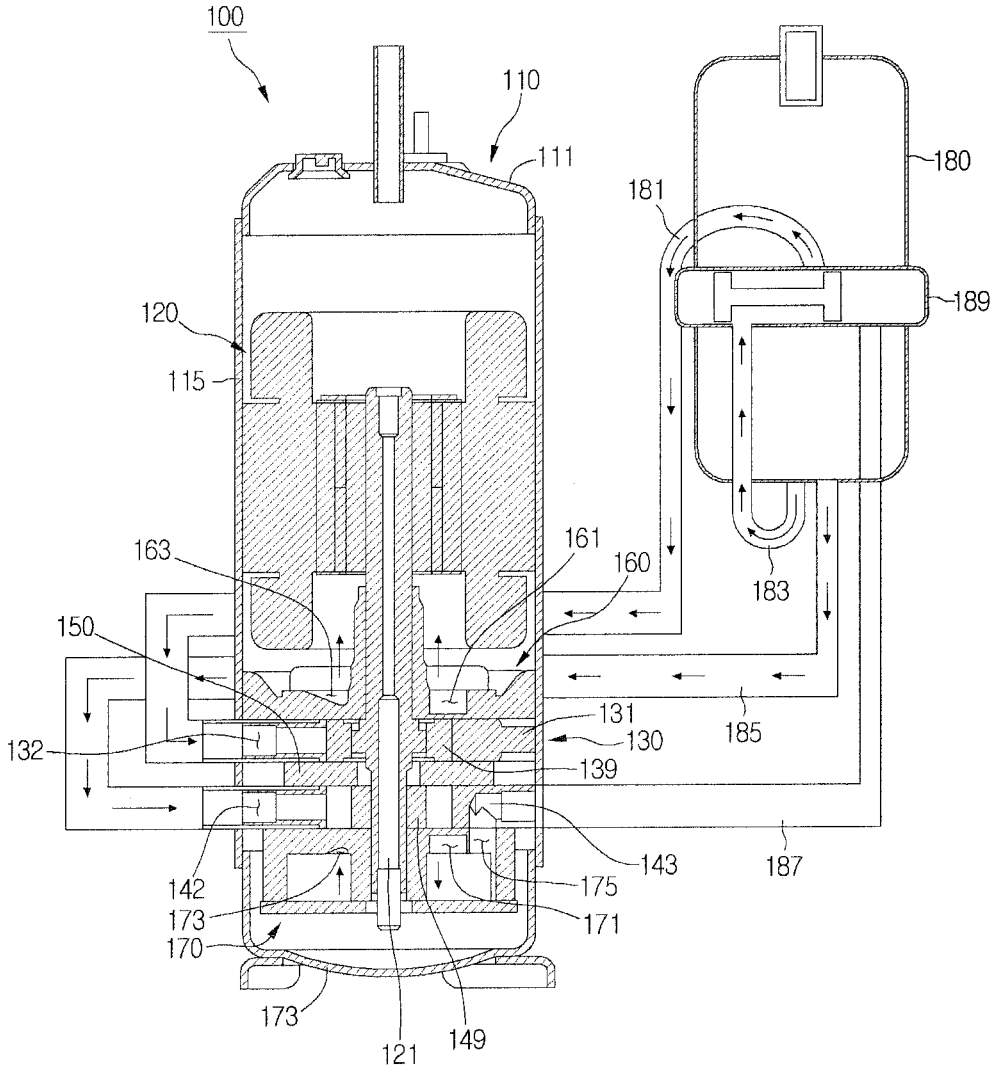
FIGS. 4 and 5 show an operation state of the compressor of FIG. 2.

Referring to FIG. 4, in case of twin compression, the four-way valve 189 allows the first and second upper refrigerant supply pipes 181 and 183 to communicate with each other and allows the first upper refrigerant supply pipe 181 and the intermediate-pressure refrigerant discharge pipe 187 to be interrupted from each other. Thus, the low-pressure refrigerant is supplied into the upper compression mechanism 130 through the first and second upper refrigerant supply pipes 181 and 183 and is supplied into the lower compression mechanism 140 through the lower refrigerant supply pipe 185.

A high-pressure refrigerant compressed in the upper compression mechanism 130 is discharged into the inner space of the shell 110 through the first refrigerant discharge port 161.

Also, the refrigerant compressed by the lower compression mechanism 140 is transferred into the lower bearing 170 through the third discharge port 171. The refrigerant transferred into the lower bearing 170 is discharged into the refrigerant discharge passage through the connection port 173.

Then, the refrigerant flows into the refrigerant discharge passage and is discharged into the inner space of the shell 110 through the second refrigerant discharge port 163. Here, since the intermediate-pressure refrigerant discharge pipe 187 is closed by the four-way valve 189, it may prevent the refrigerant within the lower bearing 170 from flowing into the intermediate-pressure refrigerant discharge pipe 187 through the intermediate-pressure refrigerant discharge port 175.

Figure 5:
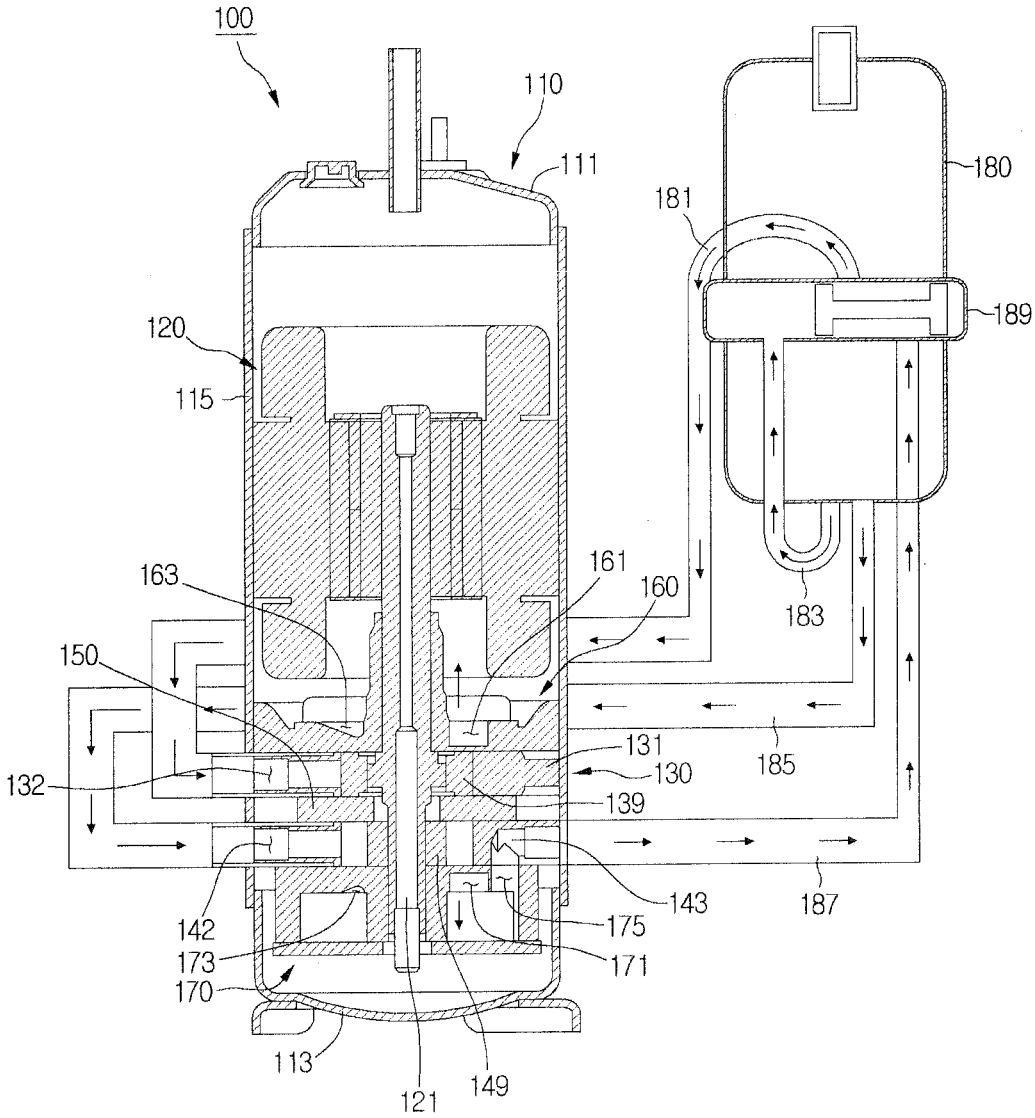

Referring to FIG. 5, in case of two-stage compression, the first and second upper refrigerant supply pipes 181 and 183 are interrupted from each other, and the first upper refrigerant supply pipe 181 communicates with the intermediate-pressure refrigerant discharge pipe 187. Thus, the low-pressure refrigerant is supplied into the lower compression mechanism 140 through the lower refrigerant supply pipe 185, and the intermediate-pressure refrigerant compressed by the lower compression mechanism 140 is supplied into the upper compression mechanism 130 through the intermediate-pressure refrigerant discharge pipe 187 and the first upper refrigerant supply pipe 181. The refrigerant supplied into the upper compression mechanism 130 is compressed by the upper compression mechanism 130 and discharged into the inner space of the shell 110 through the first refrigerant discharge port 161.

As described above, in the current embodiment, a height required for welding the pipes welded to the shell 110, i.e., the first upper refrigerant supply pipe 181, the lower refrigerant supply pipe 185, and the intermediate-pressure refrigerant discharge pipe 187 to each other may be substantially reduced. Thus, the total height of the components disposed inside the shell 110 may be reduced when compared to the related art. In addition, since the total height of the components disposed inside the shell 110 is reduced, a flow distance of oil may be substantially reduced and a center of gravity of the compressor 100 may be lowered.

As shown in FIG. 6, according to the embodiment of FIG. 2, it is seen that feed amount of oil is increased when compared to FIG. 1. In addition, as shown in FIG. 8, it is expected that coefficient of performance (COP) is substantially increased by the operation of the compressor 100 due to the improvement of the feed amount of oil. Also, as shown in FIG. 7, according to the current embodiment, it is seen that vibration occurring during the operation of the compression 100 is reduced when compared to the compressor of FIG. 1.

Figure 9:
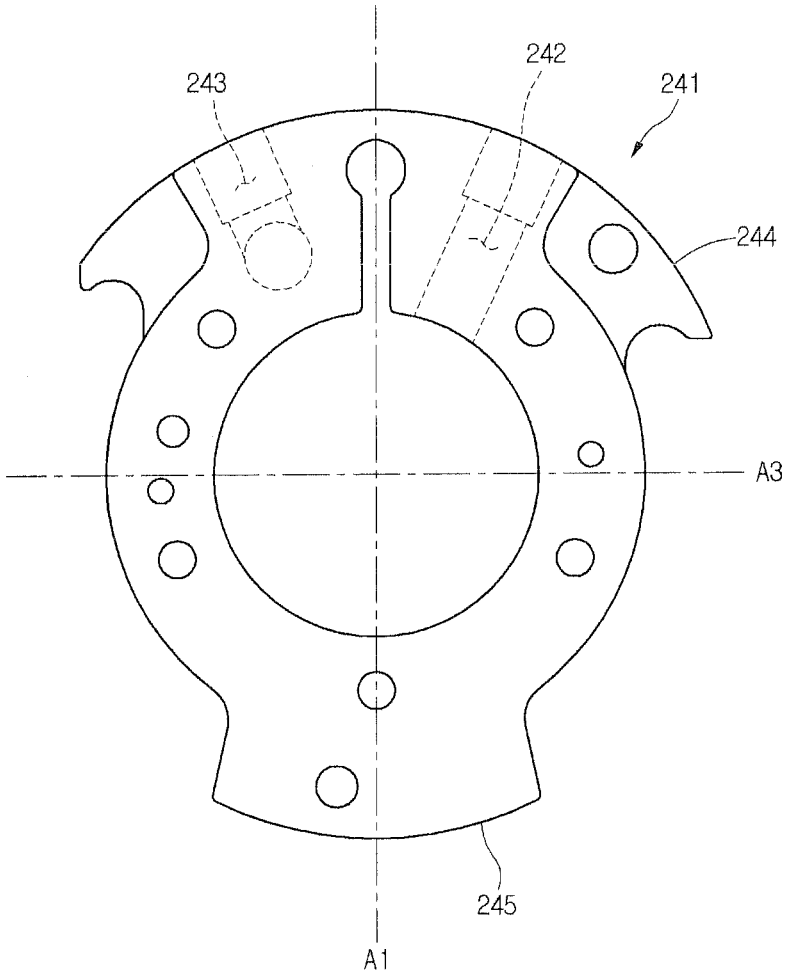
FIG. 9 shows a lower cylinder used in another embodiment of a compressor.

FIG. 9 shows a lower cylinder of another embodiment of a compressor. This embodiment may have many of the same elements as those of the embodiment of FIG. 2 and therefore like elements will be given like reference numerals.

Referring to FIG. 9, an outer end of a lower refrigerant suction hole 242 and an outer end of an intermediate-pressure refrigerant discharge hole 243 are disposed on an outer circumference of a lower cylinder 241, i.e., one of outer circumferences of first and second projections 244 and 245. In the current embodiment, the outer end of the lower refrigerant suction hole 242 and the outer end of the intermediate-pressure refrigerant discharge hole 243 are disposed on the outer circumference of the first projection 244.

Also, each of the outer end of the lower refrigerant suction hole 242 and the outer end of the intermediate-pressure refrigerant discharge hole 243 may have a preset angle with respect to a center of the lower cylinder 241. Here, the outer end of the lower refrigerant suction hole 242 and the outer end of the intermediate-pressure refrigerant discharge hole 243 may be symmetrical to each other with respect to a first line A1 and may be symmetrical to the outer end of the second projection 245 with respect to a virtual line A3 (hereinafter, for convenience of description, referred to as a 'third line') perpendicular to the first line A1.

The positions of outer end of the lower refrigerant suction hole 242 and the outer end of the intermediate-pressure refrigerant discharge hole 243 are for preventing pipes connected to the outer end of the lower refrigerant suction hole 242 and the outer end of the intermediate-pressure refrigerant discharge hole 243, i.e., a lower refrigerant supply pipe 285 and an intermediate-pressure refrigerant discharge pipe 287 from being thermally deformed when they are welded to each other.

In addition, the positions are for easily fixing the pipes in consideration of an accumulator 280 that will be described later. That is, when a central angle between the end of the lower refrigerant suction hole 242 and the outer end of the intermediate-pressure refrigerant discharge hole 243 is increased, lengths of the lower refrigerant supply pipe 285 and the intermediate-pressure refrigerant discharge pipe 287 for connecting the outer end of the lower refrigerant suction hole 242 and the outer end of the intermediate-pressure refrigerant discharge hole 243 to the accumulator 280 at predetermined positions are increased.

Also, to prevent the increase of the lengths of the pipes, the lower refrigerant supply pipe 285 and the intermediate-pressure refrigerant discharge pipe 287 should be processed. On the other hand, when the central angle between the end of the lower refrigerant suction hole 242 and the outer end of the intermediate-pressure refrigerant discharge hole 243 is decreased, the lower refrigerant supply pipe 285 and the intermediate-pressure refrigerant discharge pipe 287 may be easily fixed. However, when the lower refrigerant supply pipe 285 and the intermediate-pressure refrigerant discharge pipe 287 are welded, the lower refrigerant supply pipe 285 and the intermediate-pressure refrigerant discharge pipe 287 may be thermally deformed.

Thus, in the current embodiment, the central angle between the end of the lower refrigerant suction hole 242 and the outer end of the intermediate-pressure refrigerant discharge hole 243 is decided within a range in which the thermal deformation occurring when the lower refrigerant supply pipe 285 and the intermediate-pressure refrigerant discharge pipe 287 are fixed is prevented, and the lower refrigerant supply pipe 285 and the intermediate-pressure refrigerant discharge pipe 287 are easily fixed.

Furthermore, it may be expected that the lengths of the pipes are substantially decreased when compared to the first embodiment even though an angle between the lower refrigerant suction hole 242 and the intermediate-pressure refrigerant discharge hole 243 is less than about 180°.

In the foregoing embodiments of the compressor, in case of two-stage compression, the lower supply pipe in which the refrigerant introduced into the lower compression mechanism flows and the intermediate-pressure discharge pipe in which the refrigerant discharged from the lower supply pipe flows are connected to the lower cylinder. That is, at least two pipes of the three pipes connected to the compressor may be fixed at the same height to reduce the total height of the components disposed inside the shell.

Thus, since the motor of the components disposed inside the shell is decreased in height, discharge efficiency of the oil disposed at a lower portion of the shell may be improved. Also, since a center of overall gravity of the compressor is defined at a lower side, it may be expected that the vibration occurring when the compressor is operated is reduced. Also, since the pipe is substantially reduced in length, performance deterioration such as pressure drop may be minimized.

In accordance with one embodiment, a compression device comprises a shell; a plurality of compressors in the shell, each compressor including a rolling piston that rotates within a cylinder to compress refrigerant; a valve to control flow of refrigerant to allow the refrigerant to be simultaneously or successively compressed by the compressors; a first pipe to transfer refrigerant into one of the compressors; and a second pipe to transfer refrigerant compressed in one of the compressors to another one of the compressors when the refrigerant is successively compressed by the compression mechanisms, wherein the first and second pipes are coupled to the cylinder of one of the compressors. A bearing may also be included to receive the refrigerant compressed in one of the compressors.

The shell may comprise a top cap defining an outer appearance of an upper portion of the shell; a bottom cap defining an outer appearance of a lower portion of the shell; and a casing defining an outer appearance of a portion of the shell between the upper and lower portions of the shell, wherein the first and second pipes are coupled to the casing.

In addition, the first and second pipes are coupled to the cylinder of one of the compressors to allow at least a section of each of the first and second pipes to overlap each other.

In accordance with another embodiment, a compression device comprises a shell including a casing between a top cap and a bottom cap; an upper compressor in the shell having a first rolling piston that rotates within a first cylinder to compress refrigerant; a lower compressor in the shell having a second rolling piston that rotates within a second cylinder to compress refrigerant; a bearing through which the refrigerant compressed by the lower compressor passes, the bearing disposed under the lower compressor; an upper supply pipe to supply refrigerant to the upper compressor when refrigerant is simultaneously compressed by the upper and lower compressors; a lower supply pipe to supply refrigerant to the lower compressor when the refrigerant is simultaneously or successively compressed by the upper compressor and the lower compressor; an intermediate-pressure supply pipe to supply refrigerant compressed in the lower compressor to the upper compressor when the refrigerant is successively compressed by the upper compressor and the lower compressor; and a valve to control supply of refrigerant to the upper compressor and the lower compressor through the upper supply pie, lower supply pipe, and intermediate-pressure supply pipe to simultaneously or successively compress refrigerant by the upper compressor mechanism and the lower compressor, wherein the lower supply pipe and the intermediate-pressure supply pipe are fixed to the casing and coupled to the lower cylinder.

The refrigerant compressed by the lower compression mechanism may be discharged into the shell via the bearing or supplied into the upper compression mechanism via the bearing when the refrigerant is simultaneously or successively compressed by the upper compression mechanism and the lower compression mechanism.

In accordance with another embodiment, a compression device comprises a shell including a casing between a top cap and a bottom cap; a first compressor having a first rolling piston that rotates within a first cylinder to compress refrigerant, and a suction hole to suction refrigerant to be compressed and an intermediate-pressure discharge hole to discharge compressed refrigerant; a second compressor to simultaneously compress refrigerant with the first compressor or to successively recompress refrigerant compressed by the first compressor, the second compressor having a second rolling piston that rotates within a second cylinder to compress refrigerant; a bearing to receive refrigerant compressed by the first compressor; a first supply pipe to supply refrigerant to the first compressor when refrigerant is simultaneously or successively compressed by the first compressor and the second compressor, the first supply pipe coupled to the suction hole; a second supply pipe to supply refrigerant to the second compressor when the refrigerant is simultaneously compressed by the first compressor and the second compressor; and an intermediate-pressure discharge pipe to transfer refrigerant compressed by the first compressor to the second compressor when refrigerant is successively compressed by the first compressor and the second compressor, the intermediate-pressure discharge pipe coupled to the intermediate-pressure discharge hole. At least a portion of the bearing may be disposed under the first compressor to overlap the bottom cap.

In addition, first and second ends of the suction hole are in an inner circumference and an outer circumference of the first cylinder, wherein one of the first or second end of the suction hole in the inner circumference of the first cylinder communicates with an inner space of the first cylinder in which refrigerant is compressed, and wherein the other of the first or second end of the suction hole in the outer circumference of the first cylinder is coupled to the first supply pipe.

In addition, first and second ends of the intermediate-pressure discharge hole are in an outer circumference and a bottom surface of the first cylinder, wherein the one of the first or second end of the intermediate-pressure discharge hole in the outer circumference of the first cylinder is coupled to the intermediate-pressure discharge pipe, and the other of the first or second end of the intermediate-pressure discharge hole in the bottom surface of the first cylinder communicates with the bearing.

In addition, a direction in which refrigerant is introduced from the bearing to the intermediate-pressure discharge hole is different from a direction in which refrigerant is discharged from the intermediate-pressure discharge hole to the intermediate-pressure discharge pipe.

In addition, refrigerant introduced from the bearing to the intermediate-pressure discharge hole may be varied in direction at a preset angle and discharged into thee intermediate-pressure discharge pipe.

In addition, the suction hole and the intermediate-pressure discharge hole are spaced from each other at a preset angle with respect to a center of the first cylinder. Also, a projection for fixing the first cylinder to the shell may be disposed on an outer circumference of the first cylinder, and the suction hole and the intermediate-pressure discharge hole are defined in the projection.

In addition, the suction hole and the intermediate-pressure discharge hole are spaced from each other at a preset angle with respect to a center of the first cylinder.

In addition, first and second projections spaced from each other at a preset central angle to fix the first cylinder to the shell may be disposed on an outer circumference of the first cylinder, and the suction hole and the intermediate-pressure discharge hole are respectively defined in the first and second projections or in one of the first or second projections.

In addition, the suction hole and the intermediate-pressure discharge hole may be defined in one of the first or second projections and spaced from each other at a preset angle with respect to a center of the first cylinder.

In addition, the suction hole and the intermediate-pressure discharge hole may be defined in one of the first or second projections and are symmetrical to ends of the other one of the first or second projections with respect to a center of the first cylinder.

In addition, refrigerant compressed by the first compressor may pass through the bearing and is discharged into the shell when refrigerant is simultaneously compressed, and refrigerant compressed by the first compressor passes through the bearing to flow into the intermediate-pressure discharge pipe, thereby being transferred into the second compressor when refrigerant is successively compressed.

In addition, a valve may control flow of refrigerant to the first and second compressors through the first and second supply pipes, thereby simultaneously compressing refrigerant in the first and second compressors or to supply the refrigerant to the first compressor and to supply refrigerant compressed by the first compressor to the second compressor through the second supply pipe and the intermediate-pressure discharge pipe, thereby successively compressing refrigerant in the first and second compressors.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments. The features of one embodiment may be combined with features of remaining embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A compression device connected to an accumulator and a four-way valve, the compression device comprising:

a shell including a casing between a top cap and a bottom cap, the casing including a first suction hole, a second suction hole, and a discharge hole;

a plurality of compressors in the shell, each compressor including a rolling piston that rotates within a respective cylinder to compress a refrigerant;

a valve that controls a flow of the refrigerant to allow the refrigerant to be simultaneously or successively compressed by the plurality of compressors;

a first pipe through which the refrigerant is transferred into one of the plurality of compressors, the first pipe including a first portion coupled to the first suction hole of the shell and a second portion coupled to the accumulator;

a second pipe through which the refrigerant compressed in the one of the plurality of compressors is discharged to an outside of the shell when the refrigerant is successively compressed by the plurality of compressors, the second pipe including a first portion coupled to the discharge hole of the shell and a second portion coupled to the four-way valve; and a third pipe, which communicates with the second pipe, and through which the refrigerant is introduced into another one of the plurality of compressors the third pipe including a first portion coupled to the second suction hole of the shell and a second portion coupled to the four-way valve, wherein a height of at least a portion of the first pipe from the bottom cap is approximately the same as a height of at least a portion of the second pipe from the bottom cap, and wherein the second suction hole of the casing is located above the first suction hole of the casing.

2. The compression device of claim 1, further comprising:

a bearing to receive the refrigerant compressed in the one of the plurality of compressors.

3. The compression device of claim 1, wherein the top cap defines an outer appearance of an upper portion of the shell, the bottom cap defines an outer appearance of a lower portion of the shell and, the casing defines an outer appearance of a portion of the shell between the upper and lower portions of the shell, and wherein the first and second pipes are coupled to the casing.

4. The compression device of claim 1, wherein the first and second pipes are coupled to the cylinder of the one of the plurality of compressors such that at least a section of each of the first and second pipes overlap each other.

5. The compression device of claim 1, wherein the plurality of compressors comprises:

a first compressor having a first rolling piston that rotates within a lower cylinder to compress a refrigerant; and a second compressor having a second rolling piston that rotates within an upper cylinder located above the lower cylinder to compress the refrigerant.

6. The compression device of claim 5, further comprising:

a first projection that radially extends from a first side of an outer circumference of the lower cylinder; and a second projection that radially extends from a second side of the outer circumference of the lower cylinder, wherein the second projection is disposed opposite to the first projection.

7. The compression device of claim 6, wherein an angle formed by outer edges of the first projection with respect to a central longitudinal axis of the lower cylinder is larger than an angle formed by outer edges of the second projection with respect to a central longitudinal axis of the lower cylinder, and wherein the first suction hole is disposed on the first projection and the intermediate-pressure discharge hole is disposed on the second projection.

8. The compression device of claim 7, wherein at least a portion of the bearing is disposed under the first compressor to overlap the bottom cap.

9. The compression device of claim 7, wherein first and second ends of the first suction hole are in an inner circumference and an outer circumference of the lower cylinder, wherein one of the first end or the second end of the first suction hole in the inner circumference of the lower cylinder communicates with an inner space of the lower cylinder in which the refrigerant is compressed, and wherein the other of the first end or the second end of the first suction hole in the outer circumference of the first cylinder is coupled to the first pipe.

10. The compression device of claim 7, wherein first and second ends of the discharge hole are in an outer circumference and a bottom surface of the lower cylinder, wherein one of the first end or the second end of the discharge hole in the outer circumference of the lower cylinder is coupled to the second pipe, and wherein the other of the first end or the second end of the discharge hole in the bottom surface of the lower cylinder communicates with the bearing.

11. The compression device of claim 7, wherein a direction in which the refrigerant is introduced from the bearing to the discharge hole is different from a direction in which the refrigerant is discharged from the discharge hole to the second pipe.

12. The compression device of claim 7, wherein the refrigerant introduced from the bearing to the discharge hole is varied in a direction at a predetermined angle and discharged into the second pipe.

13. The compression device of claim 7, wherein the first suction hole and the discharge hole are spaced from each other at a predetermined angle with respect to a central longitudinal axis of the lower cylinder.

14. The compression device of claim 7, wherein the refrigerant compressed by the first compressor passes through the bearing and is discharged into the shell when the refrigerant is simultaneously compressed, and wherein the refrigerant compressed by the first compressor passes through the bearing to flow into the second pipe, thereby being transferred into the second compressor when refrigerant is successively compressed.

15. The compression device of claim 7, wherein the four-way valve controls a flow of refrigerant to the first and second compressors through the first and third pipes, thereby simultaneously compressing the refrigerant in the first and second compressors, or supplies the refrigerant to the first compressor and supplies the refrigerant compressed by the first compressor to the second compressor through the third pipe and the second pipe, thereby successively compressing the refrigerant in the first and second compressors.

16. The compression device of claim 1, wherein the second pipe comprises:

a first extension that extends from the shell in a substantially horizontal direction; and a second extension that extends from the first extension to the four-way valve in a substantially upward direction.

17. The compression device of claim 1, wherein the third pipe comprises:

a first extension that extends from the four-way valve in a substantially downward direction;

a second extension that extends from the first extension in a substantially horizontal direction;

a third extension that extends from the second extension in a substantially downward direction; and a fourth extension that extends from the third extension to the casing in a substantially horizontal direction.

* * * * *